US006173959B1

(12) United States Patent
Oikawa et al.

(10) Patent No.: US 6,173,959 B1
(45) Date of Patent: Jan. 16, 2001

(54) DIAPHRAGM-HOLDING SYNTHETIC RESIN ASSEMBLY

(75) Inventors: Kenichi Oikawa, Urawa; Noriaki Chiba, Morioka; Hideo Terada, Yaita; Rui Matuzaka, Morioka, all of (JP)

(73) Assignee: Mikuni Adec Corporation (JP)

( * ) Notice: Under 35 U.S.C. 154(b), the term of this patent shall be extended for 0 days.

(21) Appl. No.: 08/930,964

(22) PCT Filed: Feb. 13, 1997

(86) PCT No.: PCT/JP97/00375

§ 371 Date: Dec. 19, 1997

§ 102(e) Date: Dec. 19, 1997

(87) PCT Pub. No.: WO97/30283

PCT Pub. Date: Aug. 21, 1997

(30) Foreign Application Priority Data

Feb. 14, 1996 (JP) ..... 8-050936
Feb. 3, 1997 (JP) ..... 9-035491

(51) Int. Cl.[7] ..... F04B 43/02
(52) U.S. Cl. ..... 277/312; 277/178; 417/479
(58) Field of Search ..... 277/634, 635, 277/312

(56) References Cited

U.S. PATENT DOCUMENTS 3,036,526 * 5/1962 Hise ..... 103/44
3,331,611 * 7/1967 Liebig ..... 277/178
4,181,245 * 1/1980 Garrett et al. ..... 222/450
4,411,603 * 10/1983 Kell ..... 417/479
4,468,222 * 8/1984 Lundquist ..... 604/153
4,630,642 * 12/1986 Detweiler ..... 137/506

* cited by examiner

*Primary Examiner*—B. Dayoan
*Assistant Examiner*—Mark Williams
(74) *Attorney, Agent, or Firm*—Lorusso & Loud

(57) ABSTRACT

An O-ring shaped annular rib (63) is disposed around the outer periphery of a flexible diaphragm member (62), and grooves (70, 71) are formed in first and second resin members (60, 61) for receiving the annular rib (63) in the compressed state. A hollow space is defined between the first and second members (60) for holding the diaphragm (62) in the clamped state. A contact surface (64) where the first and second synthetic resin members (60, 61) come into contact with each other, is located outward of the grooves (70, 71), and is subjected to welding with a supersonic welding tool (65). A gap (76) is formed between the first synthetic resin member (60) and the supersonic welding tool (65), which gap disappears as the welding progresses. At this time, further progress of the welding operation is inhibited by allowing the first synthetic resin member (60) and the supersonic welding tool (65) to provide a predetermined compression for the annular rib (63). Alternatively, a metallic spacer (77) is interposed between the first synthetic resin member (60) and the second synthetic resin member 61 with a gap (78) between the second synthetic resin member (61) and the metallic spacer (77) prior to a welding operation, which gap (78) disappears as the welding operation progresses, until further progress of the welding operation is halted.

10 Claims, 9 Drawing Sheets

FIG. 8
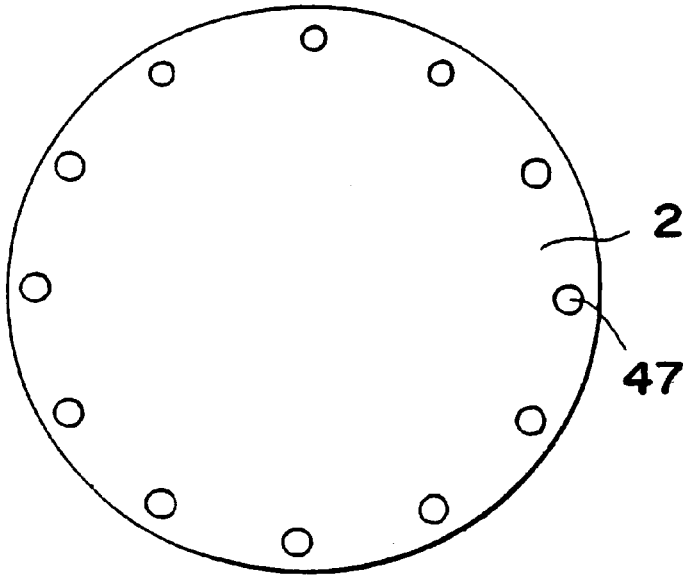
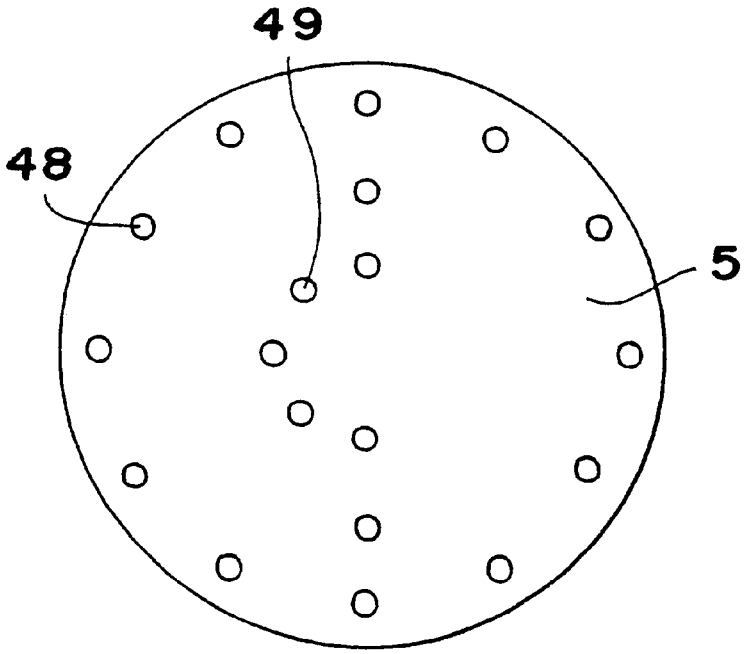
FIG. 9

DIAPHRAGM-HOLDING SYNTHETIC RESIN ASSEMBLY

TECHNICAL FIELD

The present invention relates to a synthetic resin assembly having diaphragm(s) clamped between members serving to clamp a flexible diaphragm state is molded of a resin material, and these members are welded together.

BACKGROUND ART

A diaphragm type fuel pump adapted to operate under the influence of pulsative pressure generated in a crankcase or in a suction tube is known. Here, the structure of a conventional diaphragm type fuel pump will be described below with reference to FIG. 17. A first cover 4 including a first flexible diaphragm member 2 and an annular gasket 3 in the clamped state is arranged on one side surface of a pump casing 1, and a second cover 7 including a second flexible diaphragm member 5 and a gasket 5 in the clamped state is arranged on the other side surface of the pump casing 1. While the first flexible diaphragm member 2 and the annular gasket 3 are held between the pump casing 1 and the first cover 4 in the clamped state, and moreover, the second flexible diaphragm member 5 and the gasket 5 are held between the pump casing 1 and the second cover 7 in the clamped state, these members are immovably held by tightening a plurality of bolt members 8. Usually, the first flexible diaphragm member 2 and the second flexible diaphragm member 5 are constructed by using a rubber membrane having a base fabric involved therein. However, on occasion the first flexible diaphragm 2 and the second flexible diaphragm 5 are constructed by using a resin membrane, and in this case, the gasket 3 is additionally held between the pump casing 1 and the first flexible diaphragm member 2 in the clamped state, and moreover, the gasket 6 is additionally held between the pump casing 1 and the second flexible diaphragm member 5 in the clamped state (consequently, four gaskets in total are arranged in the fuel pump in the clamped state).

A pulsation chamber 9 is formed between the first flexible diaphragm member 2 and the first cover 4, and moreover, a pump actuating chamber 10 is formed between the pump casing 1 and the first flexible diaphragm member 2. A certain intensity of pulsation pressure generated in an engine is introduced into the pulsation chamber 9 via an introduction passage 11. Further, a fuel suction chamber 12 and a fuel discharge chamber 3 are formed between the pump casing 1 and the second flexible diaphragm member 5, and moreover, an air chamber 14, corresponding to the fuel suction chamber 12 and the fuel discharge chamber 13, is formed between the second flexible member 5 and the second cover 7. With such construction, fuel is introduced into the fuel suction chamber 12 via a fuel inflow hole 15, and fuel is caused to flow out of the fuel pump via a fuel discharge hole 16.

The pump actuating chamber 10 and the fuel suction chamber 12 are communicated with each other via a fuel passage 18 having a suction valve 17 disposed therein, while the pump actuating chamber 10 and the fuel discharge chamber 13 are communicated with each other via a fuel passage 20 having a discharge valve 19 disposed therein. The suction valve 17 serving to open the fuel passage 18 is attached to a grommet 21, and additionally, this grommet 21 is attached to the pump casing 1 in such a manner as to enable it to move relative to the pump casing 1. In addition, the discharge valve 19 serving to open the fuel passage 20 is attached to a grommet 22, and this grommet 22 is attached to the pump casing 1 in such a manner as to enable it to move relative to the pump casing 1. A coil spring 23 for biasing the first flexible diaphragm member 2 in a direction expand pulsation chamber 9 is received in the pulsation chamber 9. In dependence on the nature of the pulsation pressure introduced into the pulsation chamber 9 from the crankcase, there arises an occasion that this coil spring 23 is used, and alternately, there arises an occasion that the coil spring 23 is not used.

With respect to the conventional diaphragm type fuel pump shown in FIG. 17, die cast products obtained by using aluminum or a similar metallic material by practicing a die casting process are generally used for the pump casing 1 and the first cover 4. When there arises a malfunction that a phenomenon of vapor locking appears as fuel (especially, gasoline) receives the heat generated in the engine, there occurs an occasion that a resin material having excellent thermal insulation is used for the pump casing 1 and the first cover 4. In this case, since there arises a malfunction when creep deformation occurs on the pump casing 1 and the first cover 4 as a plurality of bolt members 8 are tightened when a thermal plastic material is used, a thermosetting resin is used for the pump casing 1 and the first cover 4. However, the thermosetting resin has poor productivity. In fact, a thermosetting resin exhibiting low creep deformation is available but it is difficult to use this material on the economically acceptable basis for the reason that it is expensive.

Another problem inherent to the conventional diaphragm fuel pump consists in the fact that the annular gasket 3 and the gasket 6 adapted to be held together with the first flexible diaphragm member 2 and the second flexible diaphragm member 5 in the clamped state are expensive. In addition, since the first flexible diaphragm member 2 and a single or two annular gaskets are clamped between the pump casing 1 and the second cover 4, the second flexible diaphragm member 5 and a single or two gaskets 6 are clamped between the pump casing 1 and the second cover 7, and finally, these members are tightened in the superimposed state, the conventional diaphragm type fuel pump is unavoidably produced at an increased cost attributable to the increased man-hours required for assembling the aforementioned members.

SUMMARY OF THE INVENTION

The present invention has been made in consideration of the drawbacks inherent to the conventional diaphragm type fuel pump as mentioned above in order to eliminate the foregoing drawbacks. Therefore, an object of the present invention is to provide a synthetic resin assembly having diaphragm member(s) clamped wherein any creep deformation is not induced even though an inexpensive thermoplastic resin is used for a main body, a first cover and a second cover, gaskets hitherto used for the conventional diaphragm type fuel pump are not required, and the number of man-hours required for constructing the diaphragm type fuel pump can be reduced, In addition, another object of the present invention is to provide a synthetic resin assembly having diaphragm member(s) clamped wherein each welding operation at a welding location is where two synthetic resin members are welded together economized, and moreover, compression of each annular rib formed around the peripheral part of each diaphragm member in excess of a predetermined constant compression is reliably prevented.

DISCLOSURE OF THE INVENTION

According to the present invention, there is provided a synthetic resin assembly having diaphragm member(s)

clamped wherein a flexible diaphragm member is clamped between two members, and the diaphragm member(s) defining a hollow space are clamped between one member and one flexible diaphragm member, wherein a resin material is used for the two members, an annular rib is formed around the outer periphery of the flexible diaphragm member, a groove receives an annular rib for the flexible diaphragm member in the compressed state on at least one of the two members, and the two members are welded together around the whole peripheral edge of the groove while the annular rib is received in the groove.

In addition, according to the present invention, the synthetic resin assembly is constructed such that a surface held in the state isolated from a supersonic welding tool is formed on one synthetic resin member prior to a welding operation, and then, as the welding operation is progressively performed, the supersonic welding tool and the foregoing surface are brought in contact with each other so as to inhibit further progress of the welding operation, and moreover, the compression specified for the annular rib is kept constant.

Additionally, according to the present invention, the synthetic resin assembly is constructed such that a metallic spacer is interposed between two synthetic resin members, hollow spaces are formed for one synthetic resin member as well as for the metallic spacer, the hollow spaces are caused to disappear as the supersonic welding operation is progressively performed, further progress of the supersonic welding operation is inhibited by allowing the metallic spacer to come in contact with one synthetic resin member, and moreover, the compression specified for the annular rib is kept constant.

BRIEF DESCRIPTION OF THE DRAWINGS

FIG. 8 is a plan view showing the state before a rib for a first flexible diaphragm member having a resin diaphragm used therefor is formed on the first flexible diaphragm member.

FIG. 9 is a plan view showing the state before a rib for a second flexible diaphragm member having a resin diaphragm used therefor is formed on the second flexible diaphragm member.

DESCRIPTION OF THE PREFERRED EMBODIMENTS

Figure 1:
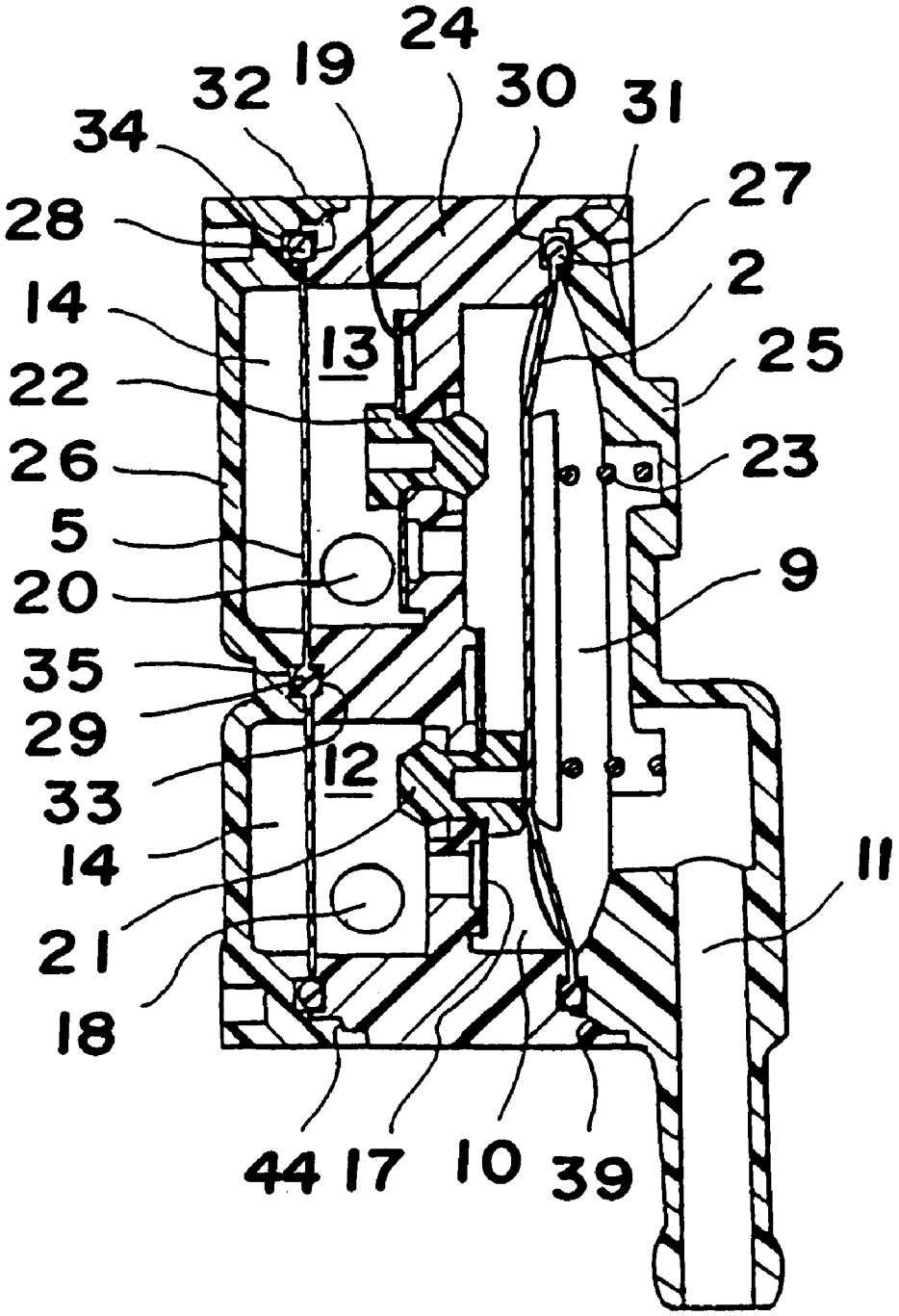
FIG. 1 is a sectional view of a synthetic resin assembly having diaphragm members clamped wherein the synthetic resin assembly is constructed for a diaphragm type fuel pump in accordance with an embodiment of the present invention.
Figure 17:
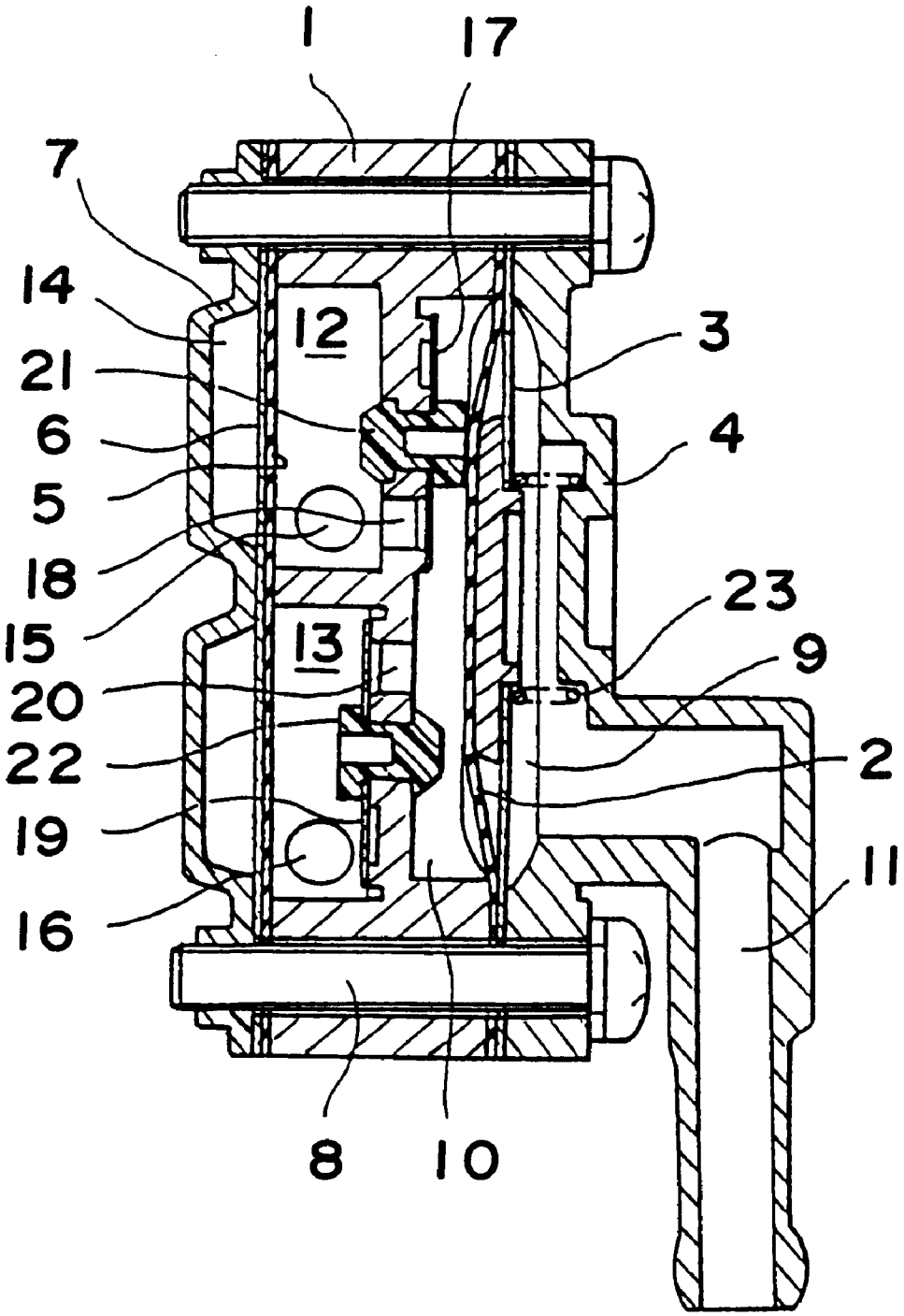
FIG. 17 is a sectional view showing the structure of a conventional diaphragm pump.

The present invention will be described in detail hereinafter with reference to the accompanying drawings. FIG. 1 is a sectional view showing a synthetic resin assembly having a diaphragm member clamped in accordance with an embodiment of the present invention. FIG. 1 shows a diaphragm type fuel pump. Same reference numerals as those shown in FIG. 17 designate same members or components.

A first flexible diaphragm member 2 is clamped between one side surface of a pump casing 24 and a first cover 25, and a second flexible diaphragm member 5 is clamped between other side surface of the pump casing 24 and a second cover 26. Each of the pump casing 24, the first cover 25 and the second cover 26 is molded of a synthetic resin.

Figure 2:
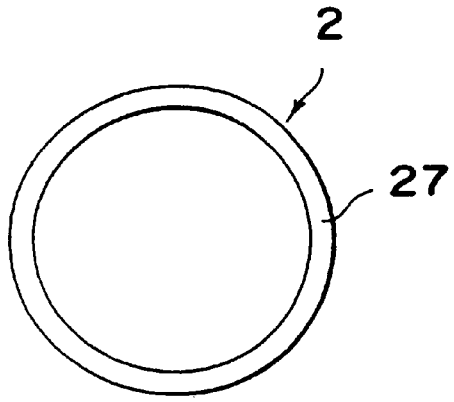
FIG. 2 is a plan view showing the contour of a rib for a first flexible diaphragm member.
Figure 3:
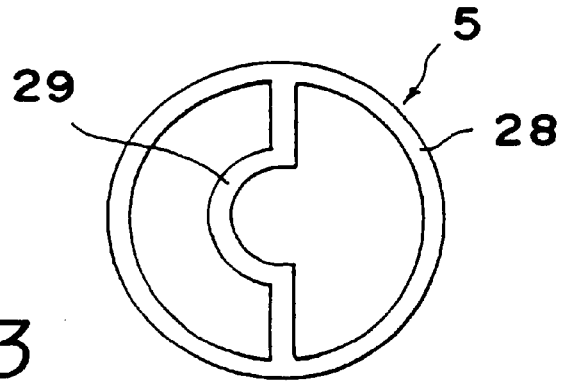
FIG. 3 is a plan view showing the contour of a rib for a second flexible diaphragm member.
Figure 4:
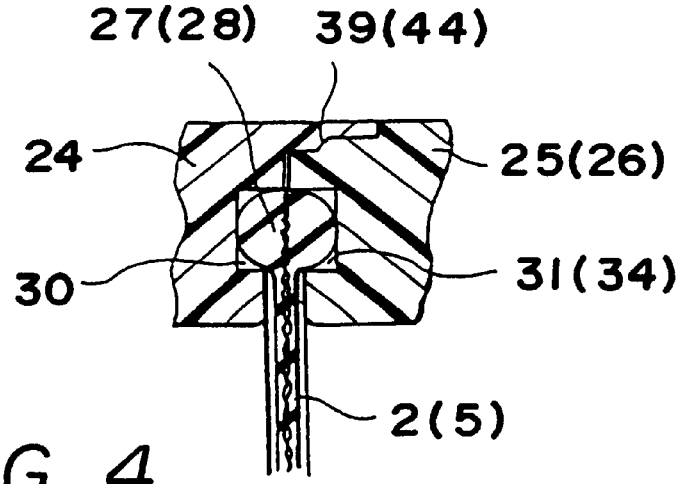
FIG. 4 is a fragmentary sectional view of the synthetic resin assembly shown in FIG. 1 wherein a joint portion between a main body and a cover is illustrated in the drawing in an enlarged scale.

As shown in FIG. 2, an O-ring shaped annular rib 27 molded of an elastic material is formed around the outer periphery of the flexible diaphragm member 2 over both the surfaces of the first flexible diaphragm member 2. In addition, as shown in FIG. 3, an O-ring shaped annular rib 28 molded of an elastic material is formed around the second flexible diaphragm member 5 over both the outer peripheral surfaces of the second flexible diaphragm member 5, and moreover, a transverse rib 29 expands transversely across the diameter of the annular rib 28. Referring to FIG. 1 again, a fuel suction chamber 12 and a fuel discharge chamber 13 are defined by the transverse rib 29, and at the same time, an air chamber 14 is also defined by the transverse rib 29. As shown in FIG. 4, each of the first flexible diaphragm member 2 and the second flexible diaphragm member 5 is constructed by a rubber membrane having a cloth layer therein.

As shown in FIG. 1 and FIG., 5, a groove 30 and a groove 31 are formed on the surface of the pump casing 24 as well as on the surface of the first cover 25 so as to allow the annular rib 27 extending around the outer peripheral edge of the first flexible diaphragm member 2 to be received therein in the compressed state. In addition, grooves 32, 33 and grooves 34 and 35 are formed on the surface of the pump casing 24 as well as on the surface of the second cover 26 so as to allow ribs 28 and 29 of the second flexible member 5 to be received therein in the compressed state.

Figure 5:
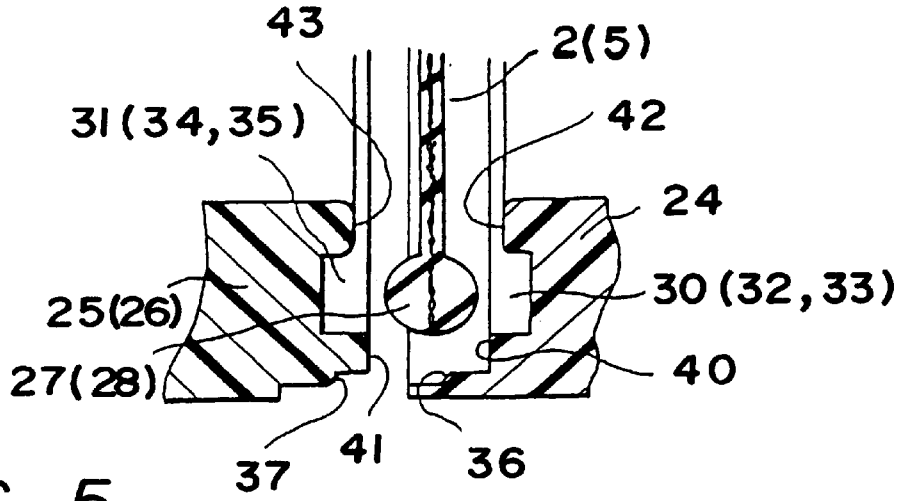
FIG. 5 is a fragmentary sectional view of the joint portion between the main body and a first cover or a second cover for the synthetic resin assembly shown in FIG. 1 wherein the joint portion is illustrated in the state prior to a joining operation in an enlarged scale.

As shown in FIG. 5, an inclined surface 36 is formed on the pump casing 24 for mating with the first cover 25 (second cover 26). A rounded outer peripheral portion 37 is formed on the first cover 25 (second cover 26) so as to mate with the inclined surface 36 of the pump casing 24. In addition, as shown in FIG. 1 and FIG. 4, a welded surface 39 (44) is formed by welding the contacting portions so as to allow the rounded peripheral portion 37 to come in contact with the inclined surface 36 (a welding method employed for welding the welding surface 39 (44) will be described later). The pump casing 24, the first cover 25 and the second cover 26 are welded together by forming the welding surface 39 (44).

In addition, as shown in FIG. 5, a surface 40 located opposite to the first cover 25 (second cover 26) is formed on the pump casing 24 between the groove 31 (34) and the inclined surface 36. On the other hand, a surface 41 located opposite to the pump casing 24 is formed on the first cover 25 (second cover 26) between the groove 31 (34) and the outer peripheral part 37. The surface 40 and the surface 41 facing to each other are located not only outside of the groove 30 (31) but also inside of the outer peripheral part 37 and the inclined surface 36 (inclined surface 47). While the pump casing 24 and the first cover 25 (second cover 26) are welded to each other, the surface 40 and the surface 41 facing to each other are designed to assume a gap having a value smaller than zero therebetween.

Additionally, a surface 42 located opposite to the first cover 25 (second cover 26) is formed on the pump casing 24 inside of the groove 30 (32). On the other hand, a surface 43 located opposite to the surface 42 on the pump casing 24 is formed on the first cover 25 (second cover 26) inside of the groove 31 (34). The surface 42 and the surface 43 facing to each other form a gap larger than zero between the first flexible diaphragm member 2 and the second flexible diaphragm member 5.

Figure 6:
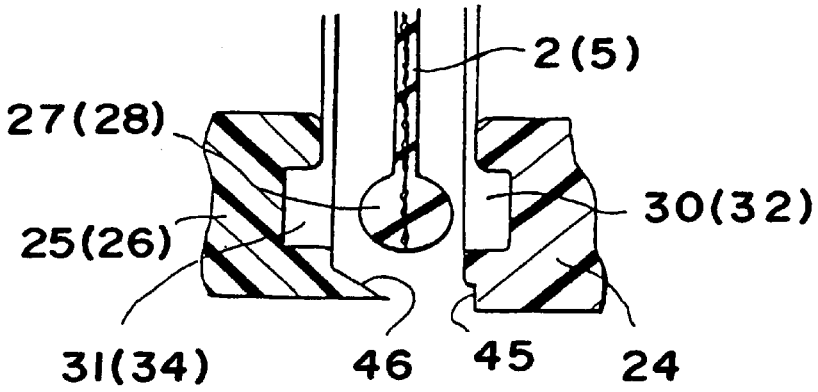
FIG. 6 is a fragmentary sectional view of the joint portion between the main body and the first cover or the second cover for the synthetic resin assembly shown in FIG. 1 wherein the joint portion is illustrated in an enlarged scale in accordance with another embodiment of the present invention.

In the case that a fuel pump is assembled with the synthetic resin assembly, firstly, the first flexible diaphragm member 2 is clamped between the pump casing 24 and the first cover 25, and moreover, the second flexible diaphragm member 5 is clamped between the pump casing 24 and the second cover 26. Thereafter, the inclined surface 36 on the outside of the groove 31 (34) formed on the first cover 25 (second cover 26) is brought in contact with the outer peripheral part 37 of the groove 31 (34), and the resultant contact surface is subjected to welding, for example, by actuating a supersonic welding unit (not shown). As shown in FIG. 1 and FIG. 4, the welded parts defined by the inclined surface 36 and the outer peripheral part 37 become welded surfaces 39 and 44. The contour of the jointed part formed between the pump casing 24 and the first cover 25 (second cover 26) should not be limited only to the contour as shown in FIG. 5. Alternatively, for example, the contour as shown in FIG. 6 may be employed. Referring to FIG. 6, a surface 45 facing to the first cover 25 (second cover 26) is formed on the pump casing 24 outside of the groove 30 (32). On the other hand, a surface 46 facing to the surface 45 is formed on the first cover (second cover 26) outside of the groove 31 (34).

Here, the rib 27 extending around the outer peripheral edge of the first flexible diaphragm member 2 is caused to positionally coincide with the groove 31 on the first flexible diaphragm member 2, and moreover, the rib 28 extending around the outer peripheral edge of the second flexible diaphragm member 5 is caused to positionally coincide with the groove 32 on the pump casing 24 and the groove on the second cover 26. Thereafter, the surface 45 of the pump casing 24 and the first cover 25 (second cover 26) are welded together.

When a rubber membrane having a cloth layer therein is used for the first flexible membrane member 2 and the second flexible membrane member 5 as shown in FIG. 4, the same material as that of the membrane portion, e.g., NBR (nitrile butadien rubber) is employed for the O-ring shaped ribs 27, 28 and 29 as a material having elasticity in order to assure that the ribs 27, 28 and 29 are supported by the cloth layer in the base fabric without any occurrence of a disconnection from the corresponding flexible diaphragm member.

Figure 7:
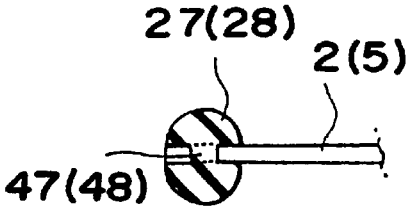
FIG. 7 is a fragmentary view showing the contour of a rib forming portion in an enlarged scale in the case that a resin diaphragm is used as a flexible diaphragm member.

Incidentally, there arises an occasion that a resin membrane film is used for the first flexible diaphragm member 2 and the second flexible diaphragm member 5. FIG. 7 is an enlarged view showing the outer peripheral part of a resin membrane in the case that resin membranes are used for the first flexible diaphragm member 2 and the second flexible diaphragm member 5. Also in the case that resin membranes are used for the diaphragm members, for example, NBR is typically employed for the ribs 27, 28 and 29 as a material having elasticity. Since the material employed for the diaphragm members is different from the material employed for the ribs, a number of small holes 47 are formed through the first flexible diaphragm member 2 made of a resin membrane at the position where the corresponding rib is arranged, as shown in FIG. 8. With respect to the first flexible diaphragm member made of a resin membrane, a rib 27 is formed by baking the resin membrane from both the surfaces. At this time, a measure is taken for filling a number of holes 47 with NBR or a similar material not only from the front surface side but also from the rear surface side in order to assure that the rib 27 will not disengaged from the diaphragm member. In addition, with respect to the second flexible diaphragm member 5, a number of small holes 48 are formed therethrough at the position where a rib 28 is likewise formed in order to assure that the rib 28 will not disengage from the second flexible diaphragm member 5, and moreover, a plurality of other small holes 49 are formed through the second flexible diaphragm member 5 at the position where a rib 29 is formed on the second flexible diaphragm member 5 in order to assure that the rib 29 will not disengage from the second flexible diaphragm member 5, as shown in FIG. 9. Subsequently, for the purpose of practical use, the state as shown in FIG. 8 is shifted to the state as shown in FIG. 2, and moreover, the state as shown in FIG. 9 is shifted to the state as shown in FIG. 3.

The structure of the present invention should not be limited only to a pulsation type fuel pump including two flexible diaphragm members. Of course, the present invention is applicable to a pulsation type fuel pump including a single flexible diaphragm member, and moreover, it is applicable to a lever type fuel pump including a single flexible diaphragm member.

Figure 10:
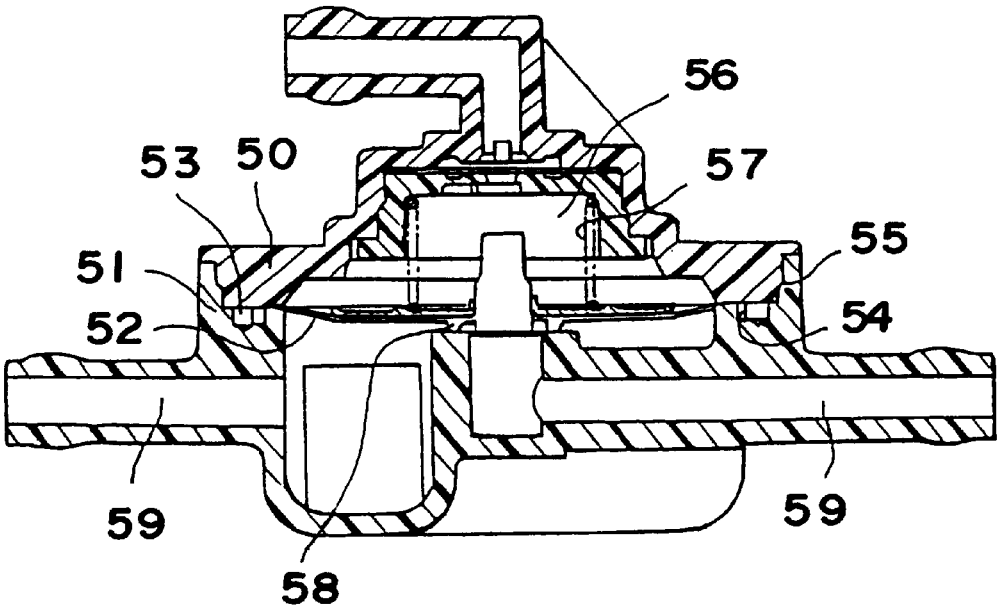
FIG. 10 is a sectional view of a synthetic resin assembly having a diaphragm member clamped for a negative type fuel cock wherein one example of the synthetic resin assembly is illustrated in the drawing.

Next, a synthetic resin assembly having a diaphragm member clamped for a negative pressure type fuel cock will be described by way of one example below with reference to FIG. 10. The negative pressure type fuel cock includes a first member 50 composed of a synthetic resin member and a second member 51 composed of a synthetic resin member, and a single diaphragm member 52 is clamped between the first member 50 and the second member 51. An annular rib 53 is formed around the peripheral part of the diaphragm member 52. This annular rib 53 is formed only on the one side of the diaphragm member 52, i.e., only on the second member 51 side, and an annular groove 54 is formed only on the surface facing to the first member 50 in the second member 51 for receiving the annular rib 53 therein in the compressed state. The concept that the annular rib 53 serves to maintain airtightness between the interior of the synthetic resin assembly and the exterior of the same is the same as in the case shown in FIG. 1. The first member 50 and the second member 51 are welded together by employing a supersonic welding process at a mutual contact location 55 situated outside of the position where the annular rib 53 is received in the annular groove 54 in the compressed state.

The function obtainable from this negative pressure type fuel cock is such that when an engine (not shown) starts its operation, the negative pressure generated by the engine is introduced into a negative pressure chamber 56, the diaphragm member 52 is displaced against the resilient force of a spring 57, and a valve portion 58 formed at the central part of the diaphragm member 52 is displaced away from the working position, opening a fuel passage 59. While the engine continues its operation, the foregoing state is maintained but when the operation of the engine is interrupted, the genration of negative pressure is discontinued, whereby the valve portion 58 is brought in the sitting state by the resilient force of the spring 57, closing the fuel passage 59. With respect to the synthetic resin assembly having diaphragm member(s) clamped as shown in FIG. 1 and FIG. 10 wherein two synthetic resin members having a diaphragm member clamped there between are welded together by employing the supersonic welding process, the airtightness between the interior of the synthetic resin assembly and the exterior of the same is maintained by the annular rib formed around the periphery of each diaphragm member.

When two members each molded of a synthetic resin for clamping a diaphragm member therebetween are welded together by employing the supersonic welding process, there arises a necessity for controlling these two members in such a manner that a compression specified for the annular rib 27 or the like is kept at an adequate constant compression rate. The foregoing necessity will be described below with reference to FIG. 11.

Figure 11:
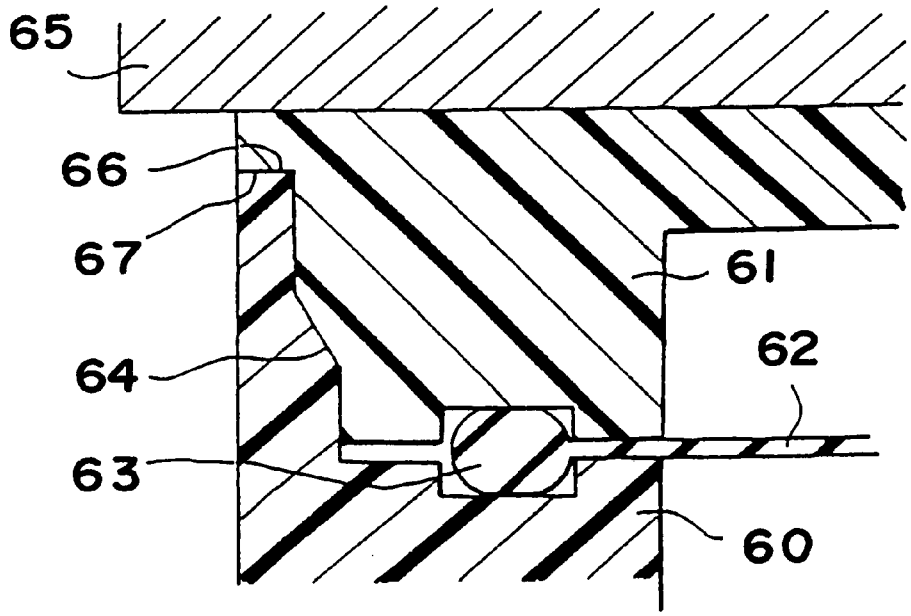
FIG. 11 is a fragmentary sectional view showing in an enlarged scale the state where a welding operation is completed for the synthetic resin assembly having a diaphragm member clamped according to the present invention.

FIG. 11 is a sectional view showing in an enlarged scale the state that two synthetic resin members having a diaphragm member clamped therebetween are welded together by employing a supersonic welding process. Referring to FIG. 11, an annular rib 63 formed around the peripheral part of an annular member 62 is clamped between a first synthetic resin member 60 and a second synthetic resin member 61. Here, when it is assumed that the first synthetic resin member 60 and the second synthetic resin member 61 substantially correspond to the members shown in FIG. 1, one member corresponds to the pump casing 24 and other member corresponds to the first cover 25 or the second cover 26. In addition, when it is assumed that the first synthetic resin member 60 and the second synthetic resin member 61 substantially correspond to the members shown in FIG. 10, one member corresponds to the first member 50 and other member corresponds to the second member 51. A contact location 64 situated outside of the position where the annular rib 63 is clamped between the first synthetic resin member 60 and the second synthetic resin member 61 corresponds to the position where the first synthetic resin member 60 and the second synthetic resin member 61 are welded together by employing the supersonic welding process. Specifically, when the first synthetic resin member 60 and the second synthetic resin member 61 are welded together by employing the supersonic welding process, this supersonic welding process is practiced such that, for example, the first synthetic resin member 60 is placed on a fixing jig (not shown), the second synthetic resin member 61 is subsequently placed on the fixing jig, and thereafter, the contact location 64 is subjected to supersonic welding while the second synthetic resin member 61 is pressed in the downward direction by actuating a supersonic welding tool 65. When two thermoplastic resins of the same type are squeezed together, the contact location 64 serving as a common contact surface therebetween is melted by frictional heat, causing them to be welded together.

Here, in association with the second synthetic resin member 61, when a surface 67 is formed at the position where it is located opposite a shoulder surface 66 of the first synthetic member 60, and then, the second synthetic resin member 61 is pressed in the downward direction, the shoulder surface 66 of the first synthetic resin member 60 is brought in contact with the surface 67 of the second synthetic resin member 61, whereby the resultant contact surface serves as a stopper for preventing excessive welding between the first synthetic resin member 60 and the second synthetic resin member 61.

With the structure as shown in FIG. 11 for preventing excessive welding, when an excessive compressing force as well as an excessive intensity of supersonic energy are applied to the foregoing structure irrespective of the controlling operation performed for the welding time or when the aforementioned surfaces 66 and 67 each serving as a stopper have a small area, respectively, melting appears on the contact surfaces, and consequently, the function for preventing excessive supersonic welding from being performed is lost, with the result that there is a danger that the compression specified for the annular rib 63 can not be maintained. For this reason, to assure that the compression of the annular rib 63 is kept constant during each supersonic welding operation, there arises a necessity for taking special care to properely select the degree of compressing and intensity of supersonic energy.

In addition, there is available means for preventing each supersonic welding operation from being excessively performed by controlling the welding time by actuating the supersonic welding tool 65, and moreover, by controlling extent of downward movement during the supersonic welding operation. However, since it is necessary to perform a confirming operation with respect to the compression specified for the annular rib 63 when a welding time and an extent of downward movement during each supersonic welding operation are preset, there arises a necessity for changing these preset conditions every time a change is made to dimensions of certain component or member.

Here, description will be made below with respect to further improvement to be achieved according to the present invention.

Figure 12:
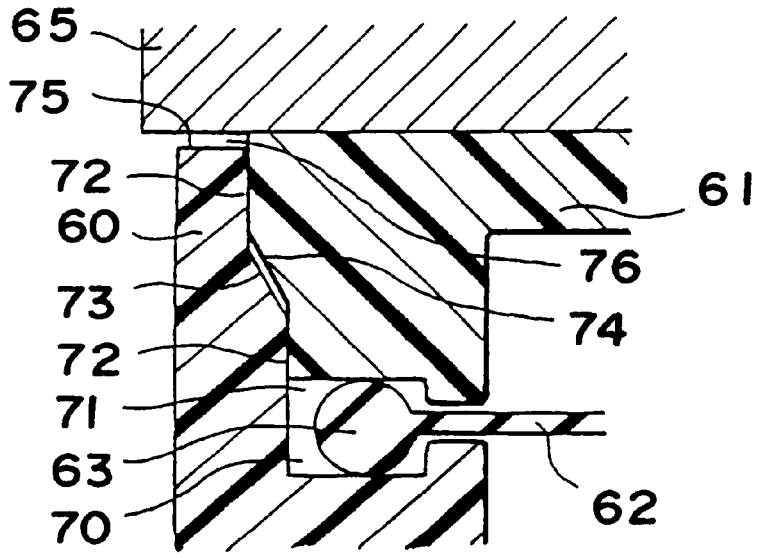
FIG. 12 is a fragmentary sectional view showing the synthetic resin assembly in an enlarged scale wherein an essential part of the synthetic resin assembly is illustrated with respect to the state prior to completion of the welding operation in accordance with the foregoing embodiment of the present invention.

FIG. 12 is a fragmentary sectional view of an essential part showing in an enlarged scale the state assumed prior to a supersonic welding operation. An annular groove 70 is formed in a first synthetic resin member 60, and additionally, an annular groove 71 located opposite to the annular groove 70 is formed around the outer periphery of the inner end surface of a second synthetic resin member 61, whereby an annular rib 63 extending around the outer periphery of a diaphragm member 62 is received in the annular groove 70 and the annular groove 71. One example wherein the annular rib 63 is formed over both the surfaces of the diaphragm member 62 is illustrated in FIG. 12. The annular rib 63 may be formed only on the one surface side of the diaphragm member 62 in the same manner as the negative pressure fuel cock is constructed as shown in FIG. 10. Alternatively, either the groove 70 or the groove 71 may be formed on the diaphragm member 62.

A first synthetic resin member 60 and a second synthetic resin member 61 are fitted to each other around an outer fitting portion 72, of each of the grooves 70 and 71. Opposing surfaces 73 and 74, to be welded in joining the first synthetic resin member 60 and the second synthetic resin member 61, are formed adjacent to the fitting portion 72. Since an outer end surface 75 of the first synthetic resin member 60 is located opposite to the supersonic welding tool 65, a gap 76 is formed between the outer end surface 75 and the supersonic welding tool 65 as shown in FIG. 12. While the first synthetic resin member 60 is placed on a fixing jig (not shown), and subsequently, the second synthetic resin member 61 is placed on the first synthetic resin member 60, the second synthetic resin member 61 is squeezed toward the first synthetic resin member 60 in the downward direction with the aid of the supersonic welding tool 65 such as a supersonic horn or the like.

Figure 13:
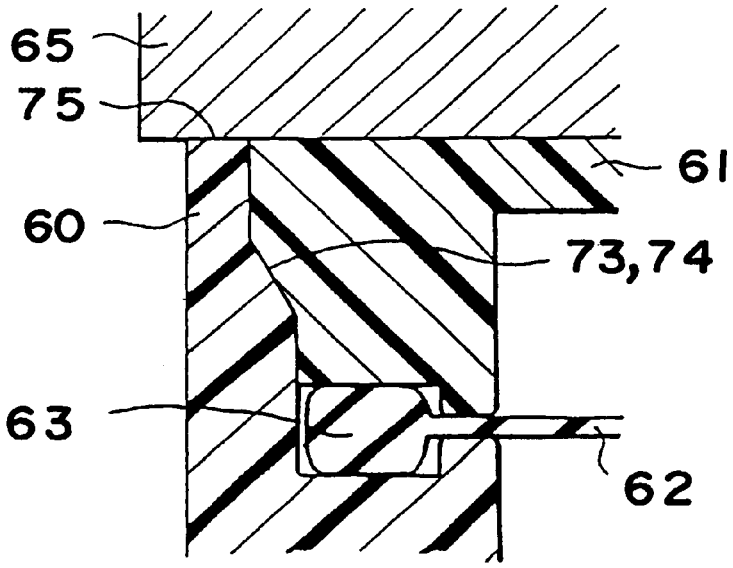
FIG. 13 is a fragmentary sectional view showing the synthetic resin assembly in an enlarged scale wherein the foregoing essential part of the synthetic resin assembly is illustrated with respect to the state assumed on completion of the welding operation with some deformation induced from the state shown in FIG. 12.

FIG. 13 is a fragmentary sectional view showing in an enlarged scale the state assumed after completion of the supersonic welding operation achieved for the first synthetic resin member 60 and the second synthetic resin member 61. When the second synthetic resin member 61 is squeezed in the downward direction from the state shown in FIG. 12, the surface 73 and the surface 74 are welded together and the outer end surface 75 of the first synthetic resin member 60 is brought in contact with the supersonic welding tool 65, whereby progress of the supersonic welding operation is interrupted, resulting in the state shown in FIG. 13 being assumed. Here, the compression specified for the annular rib 63 can be kept constant by presetting the foregoing gap to a predetermined distance. The contact surface defined by bringing the first synthetic resin member 60 in contact with the supersonic welding tool 65 should not be limited only to the formation of a continuous annular contour. Alternatively, a fragmentary contact surface may be formed on the first synthetic resin member 60.

Figure 14:
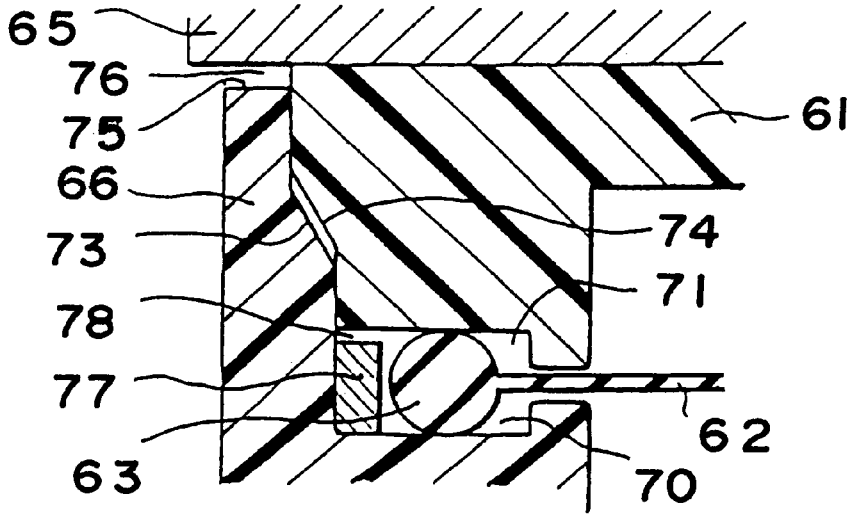
FIG. 14 is a fragmentary sectional view showing the synthetic resin assembly in an enlarged scale wherein the foregoing essential part of the synthetic resin assembly is illustrated with respect to the state assumed prior to a welding operation in accordance with another embodiment of the present invention.
Figure 15:
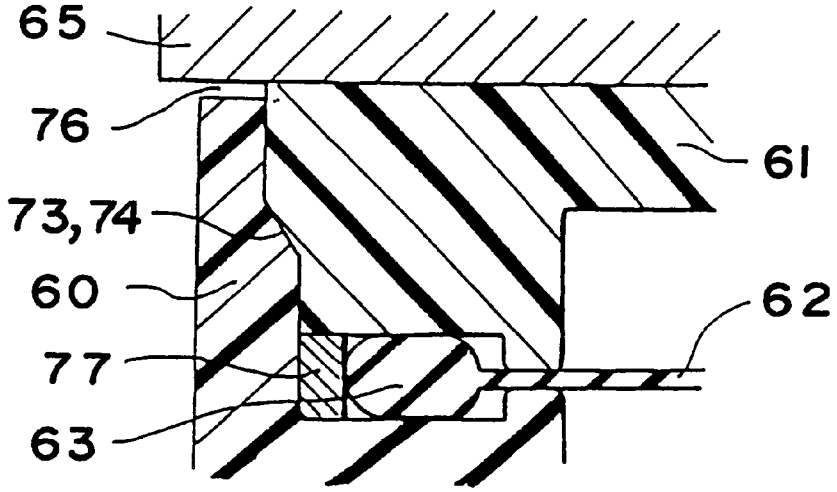
FIG. 15 is a fragmentary sectional view showing the synthetic resin assembly in an enlarged scale wherein the foregoing essential part of the synthetic resin assembly is illustrated with respect to the state assumed after completion of the welding operation in accordance with another embodiment of the present invention.

Next, description will be made below with reference to FIG. 14 and FIG. 15 with respect to a synthetic resin assembly having a diaphragm member clamped in accordance with another embodiment of the present invention. FIG. 14 shows the state prior to a supersonic welding operation, and FIG. 15 shows the state assumed after completion of the supersonic welding operation. Referring to FIG. 14, a metallic spacer 77 is placed in the space defined between an annular groove 70 formed in a first synthetic resin member 60 and an annular groove 71 formed in a second synthetic resin member 61. The first synthetic resin member 60 and the second synthetic resin member 61 are designed in such a manner that a gap 78 is formed between the metallic spacer 77 and the wall surface of the annular groove 71. When a supersonic welding operation is started from the state shown in FIG. 14 with the aid of a supersonic welding tool 65, the supersonic welding operation proceeds until the wall surface of the annular groove 71 comes in contact with the metallic spacer 77, whereby a surface 73 of the first synthetic resin member 60 and a surface 74 of the second synthetic resin member 61 are welded together. When the wall surface of the annular groove 71 comes in contact with the metallic spacer 77, further progress of the supersonic welding operation is prevented, causing the supersonic welding operation to be completed. As a result, the state as shown in FIG. 15 is assumed by the first synthetic resin member 60 and the second synthetic resin member 61. At this time, melting does not occur even though the thermoplastic synthetic resin and the metallic material (metallic spacer 77) are squeezed together as supersonic vibration is induced in them.

To assure that an outer end surface 75 of the first synthetic resin member 60 is not brought in contact with the supersonic welding tool 65 before each supersonic welding operation is completed, the first synthetic resin member 60 and the second synthetic resin member 61 are designed in such a manner that a sufficiently large gap 76 is maintained therebetween. In addition, to assure that the size of the gap 76 is not reduced to zero, even after completion of the supersonic welding operation (see FIG. 15), the first synthetic resin member 60 and the second synthetic resin member 61 are designed in such a manner that the size of the gap 76 is correctly predetermined.

Figure 16:
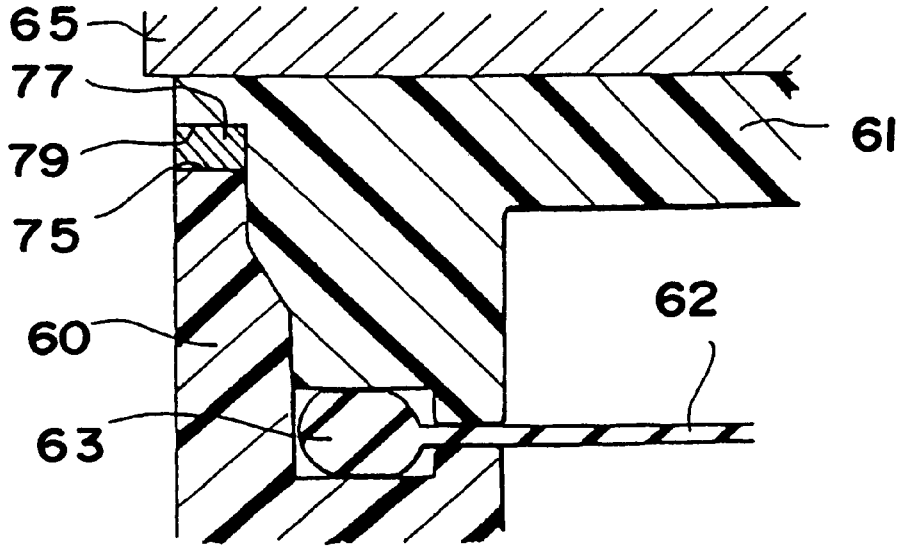
FIG. 16 is a fragmentary sectional view showing the synthetic resin assembly in an enlarged scale wherein the foregoing state of the synthetic resin assembly is illustrated with respect to the state assumed after completion of the welding operation in accordance with another embodiment of the present invention.

FIG. 16 shows a synthetic resin assembly having a diaphragm member clamped in accordance with another embodiment of the present invention.

In the case as shown in FIG. 11, the synthetic resin assembly is constructed such that further progress of the supersonic welding operation is inhibited by direct contact of the outer end surface 66 of the first synthetic resin member 60 with the surface 67 formed on the second synthetic resin member 61 at the time of completion of the supersonic welding operation. On the contrary, in the case of the synthetic resin assembly constructed in accordance with the embodiment of the present invention shown in FIG. 16, a metallic spacer 77 is interposed between an opposing surface 75 of the first synthetic resin member 60 and an opposing surface 79 of the second synthetic resin member 61. While the state assumed before completion of each supersonic welding operation is maintained, the metallic spacer 77 is not brought in contact with the opposing surface 79 of the second synthetic resin member 61. Thereafter, when the supersonic welding operation progresses to cause the opposing surface 79 of the second synthetic resin member 61 to come in contact with the metallic spacer 77, this supersonic welding operation is completed (to assume the state shown in FIG. 16). In this connection, the height of the metallic spacer 77 is predetermined such that when the annular rib 63 is compressed to obtain the constant compression of the annular rib 63 is further progress of the supersonic welding operation is halted.

As a result, when two synthetic resin members each having a diaphragm member including an annular rib around the peripheral part thereof in the clamped state are subjected to supersonic welding, the progress of the supersonic welding operation is caused to stop by the presence of the metallic spacer 77. Thus, the annular rib 63 of the diaphragm member 62 is compressed to assume a constant compression suitably employable for the supersonic welding operation, and excessive compression of the annular rib 63 can reliably be prevented.

With the synthetic resin assembly having diaphragm(s) clamped according to the present invention, since a main body and cover(s) are molded of a synthetic resin, fuel contained in the synthetic resin assembly is little heated by the heat generated by an engine. Consequently, the main body and the cover(s) each molded of the same kind of synthetic resin can be connected to each other by employing a welding process. Further, since no tightening is required with bolt members extending through the main body and the cover(s), creep deformation is not induced in the main body and the cover(s).

In addition, the number of parts or components arranged in the synthetic resin assembly can be reduced not only by the omission of gaskets but also by the omission of bolt members and the like, and moreover, an inexpensive thermoplastic resin can be employed for the synthetic resin assembly, whereby cost of the main body and the cover(s) of the synthetic resin assembly can be reduced, and additionally, the number of man-hours required for building the synthetic resin assembly can be reduced, resulting in the cast of producing the synthetic resin assembly being reduced. Further, the weight of the synthetic resin assembly can be reduced by the omission of bolt members or the like.

With the synthetic resin assembly having diaphragm(s) clamped according to the present invention, since there does not appear to be melting between the thermoplastic resin and the metallic spacer, the supersonic welding tool or the metallic spacer can be used as a stopper for inhibiting further progress of the supersonic welding operation, whereby the annular ribs formed the diaphragm members are not compressed in excess of a predetermined compression when the two synthetic resin members are welded together.

What is claimed is:

1. A synthetic resin assembly comprising:

a pair of resin members having peripheral mating portions which, when mated, define a hollow interior, and an annular groove formed in at least one of said mating portions, said mating portions including surface portions adapted to be welded together supersonically while squeezing said resin members together;

a flexible diaphragm mounted between said resin members, said flexible diaphragm having an annular rib around an outer peripheral portion thereof, said annular rib being received in said groove for forming a peripheral seal; and a metallic spacer mounted in one of said peripheral mating portions with a gap between said metallic spacer and the other of said peripheral mating portions, said gap defining the extent of relative movement between said resin members upon squeezing with the supersonic welding.

2. A synthetic resin assembly according to claim 1 wherein said rib is formed in sections on opposing sides of the outer peripheral portion and wherein said sections are joined together through holes in said outer peripheral portion.

3. A synthetic resin assembly according to claim 1 wherein said resin members further have transverse ribs providing transverse mating surfaces and dividing said hollow interior into a pair of hollow chambers, at least one of said transverse mating surfaces having a transverse groove therein, said flexible diaphragm having a transverse rib received in said transverse groove for forming a seal between said chambers.

4. A synthetic resin assembly according to claim 3 wherein said annular ribs and said transverse rib are each formed in sections on opposing sides of the outer peripheral portions and a transverse portion, respectively, of said diaphragm, wherein said peripheral portion has holes through which the sections of said peripheral rib are joined, and wherein said transverse portion has holes through which the sections of said transverse rib are joined.

5. A synthetic resin assembly according to claim 1 wherein a groove is formed in each of said mating portions and wherein said metallic spacer is mounted within the hollow space defined by the two grooves when mated together.

6. A synthetic resin assembly according to claim 1 wherein said gap has a width predetermined to, upon closing, provide a predetermined extent of compression in said annular rib.

7. A synthetic resin assembly according to claim 1 wherein said surface portions are welded together and wherein said gap is closed.

8. A synthetic resin assembly according to claim 1 wherein said rib is formed in sections on opposing sides of the outer peripheral portion and wherein said sections are joined together through holes in said outer peripheral portion.

9. A synthetic resin assembly comprising:

a pair of telescopically fitted inner and outer resin members, said inner and outer resin members defining, respectively, opposing, planar outer surfaces of said assembly, said inner and outer resin members having peripheral mating portions which define a hollow interior therebetween and an annular groove in at least one of said peripheral mating portions, said mating portions including surface portions including first and second cylindrical surfaces extending perpendicular to and connecting the outer surface with a distal end of each resin member, said first and second cylindrical surfaces being separated by an intermediate third surface;

a flexible diaphragm mounted between said inner and outer resin members, said flexible diaphragm having an annular rib around an outer peripheral portion thereof, said annular rib being received in said groove for forming a peripheral seal between said inner and outer resin members; and wherein said distal end of said outer resin member forms an annular shoulder radially outward of the peripheral mating portion of said outer resin member, wherein in a first position said annular shoulder is recessed a predetermined distance from the outer surface of said assembly defined by said inner resin member, said first and second cylindrical surfaces of said inner resin member are in contact, respectively, with said first and second cylindrical surfaces of said outer resin member and said third surfaces of said inner and outer resin members are spaced apart, said predetermined distance providing for compression of said annular rib upon telescopic movement of said inner resin member toward said outer resin member to a second position where said shoulder is flush with said outer surface defined by said inner resin member and said third surfaces of said first and second resin members are in contact.

10. A synthetic resin assembly according to claim 9 wherein said inner and outer resin members have been telescoped together to bring said shoulder flush with said outer surface defined by said inner resin member, wherein said rib is compressed by an amount proportional to said predetermined distance and wherein said surface portions are welded together.

* * * * *

UNITED STATES PATENT AND TRADEMARK OFFICE

CERTIFICATE OF CORRECTION

PATENT NO. : 6,173,959 B1
DATED : January 16, 2001
INVENTOR(S) : Oikawa et al.

It is certified that error appears in the above-identified patent and that said Letters Patent is hereby corrected as shown below:

Column 1,
Line 7, delete "state is" insert -- therebetween are --;
Line 30, delete "involved".

Column 2,
Line 59, delete "is"; and
Line 65, delete "DISCLOSURE OF THE INVENTION".

Column 5,
Line 33, delete "welding" and insert -- welded --.

Column 6,
Line 53, delete "disengaged" and insert -- disengage --.

Column 9,
Line 59, delete "assumed".

Column 10,
Line 54, delete "is".

Column 11,
Line 13, after "whereby" insert -- the --;
Line 16, delete "cast" insert -- cost --;
Line 19, delete "or" insert -- and --;
Line 26, after "formed" insert -- on --.

Signed and Sealed this

Sixteenth Day of April, 2002

*Attest:*

*Attesting Officer*

JAMES E. ROGAN
*Director of the United States Patent and Trademark Office*